US005556359A

United States Patent [19]

Clementi

[11] Patent Number: 5,556,359

[45] Date of Patent: Sep. 17, 1996

[54] HAND GRIP EXERCISE DEVICE

[76] Inventor: David Clementi, 84 Mayflower Ave., Massapequa Park, N.Y. 11762

[21] Appl. No.: 489,923

[22] Filed: Jun. 12, 1995

[51] Int. Cl.[6] ..... A63B 23/16

[52] U.S. Cl. ..... 482/49; 482/123; 482/126; 482/44

[58] Field of Search ..... 482/49, 44, 121, 482/122, 123, 126, 129

[56] References Cited

U.S. PATENT DOCUMENTS

| | | | |
|---|---|---|---|
| 668,473 | 2/1901 | Yount | 482/49 |
| 938,348 | 10/1909 | Stull | 482/49 |
| 4,783,067 | 11/1988 | Palmer | 482/49 |
| 5,125,878 | 6/1992 | Wingate et al. | 482/49 |
| 5,160,303 | 11/1992 | Smith | 482/44 |

FOREIGN PATENT DOCUMENTS

| | | | |
|---|---|---|---|
| 2064342 | 6/1981 | United Kingdom | 482/44 |

*Primary Examiner*—Lynne A. Reichard
*Attorney, Agent, or Firm*—Michael I. Kroll

[57] ABSTRACT

An improved hand grip exercise device comprising a framework. A facility is for mounting a first rod in a generally horizontal stationary position within the framework. An assemblage is for mounting a second rod in a generally horizontal movable position within the framework, that is spaced below the first rod. A structure is for biasing the second rod away from the first rod within the framework. A person can grip the first rod and the second rod by the hand and squeeze the second rod up towards the first rod, to increase the strength of the grip and the fitness of the hand.

3 Claims, 2 Drawing Sheets

HAND GRIP EXERCISE DEVICE

BACKGROUND OF THE INVENTION

1. Field of the Invention

The instant invention relates generally to exercise equipment and more specifically it relates to an improved hand grip exercise device.

There has been a dramatic rise in people's interest in physical fitness, especially in the past ten years. Health care professionals in general have been recommending exercising activities, such as full high impact aerobic workouts, walking and utilizing various types of exercising equipment, in order to reduce specific cholesterol levels, reduction of hypertensive states, improved generalized circulation with better cardiac function and most important develop muscle tone. The trend has led to the development of many various types of exercise devices which provide both aerobic and toning benefits. It is well evident that judging by todays lifestyle where time is precious and productivity will be paramount, people in general are and will be looking for more time efficient modes of exercise. This is observed on a daily basis by the rapid rise in sales of home exercise equipment, which include stationary bikes, rowing machines, stair machines and other forms of body building equipment.

2. Description of the Prior Art

Numerous exercise equipment have been provided in prior art that are adapted to build up muscle tone development, when people exert themselves when operating this equipment. While these units may be suitable for the particular purpose to which they address, they would not be as suitable for the purposes of the present invention as heretofore described.

SUMMARY OF THE INVENTION

A primary object of the present invention is to provide an improved hand grip exercise device that will overcome the shortcomings of the prior art devices.

Another object is to provide an improved hand grip exercise device that will increase the strength of the grip and the fitness of the hands when a person exercises with the device.

An additional object is to provide an improved hand grip exercise device that is lightweight and compact, so that the device can be used to tone the muscles in the hands by the person doing a lot of repetitive squeezing exercises with the device.

A further object is to provide an improved hand grip exercise device that is simple and easy to use.

A still further object is to provide an improved hand grip exercise device that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Similar reference characters denote corresponding features consistently throughout the attached drawings.

DETAILED DESCRIPTION OF THE PREFERRED EMBODIMENTS

Figure 4:
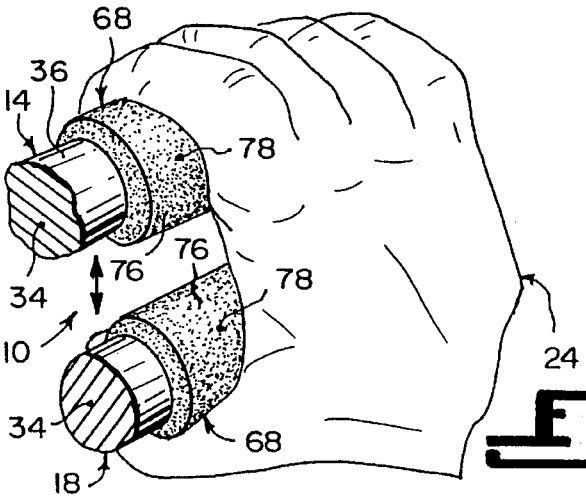
FIG. 4 is a perspective view of a portion of the instant invention showing a hand of a person exercising therewith.

Turning now descriptively to the drawings, in which similar reference characters denote similar elements throughout the several views, FIGS. 1 through 4 illustrate an improved hand grip exercise device 10, comprising a framework 12. A first rod 14 is provided. A facility 16 is for mounting the first rod 14 in a generally horizontal stationary position within the framework 12. A second rod 18 is also provided. An assemblage 20 is for mounting the second rod 18 in a generally horizontal movable position within the framework, that is spaced below the first rod 14. A structure 22 is for biasing the second rod 18 away from the first rod 14 within the framework 12. A person can grip the first rod 14 and the second rod 18 by the hand 24, as shown in FIG. 4, and squeeze the second rod 18 up towards the first rod 14, to increase the strength of the grip and the fitness of the hand 24.

The framework 12 includes a base plate 26 and a pair of side panels 28. Each side panel 28 extends upwardly from one opposite side edge of the base plate 26.

The base plate 26 is rectangular shaped and fabricated out of a strong lightweight material 30, such as plastic or aluminum. Each side panel 28 is triangular shaped and fabricated out of the strong lightweight material 30. The base plate 26 and the side panels 28 are integral, so as to form one complete unit.

The first rod 14 is a first elongated solid cylindrical bar 32. The first elongated solid cylindrical bar 32 is fabricated out of a strong lightweight material 34, such as plastic or aluminum.

The second rod 18 is a second elongated solid cylindrical bar 36. The second elongated solid cylindrical bar 36 is fabricated out of the strong lightweight material 34.

The first rod mounting facility 16 includes each side panel 28 of the framework 12 having an upper aperture 38 therethrough. Each end 40 of the first rod 14 can be force fitted into each upper aperture 38 of each side panel 28 to be retained thereto.

The second rod mounting assemblage 20 includes each side panel 28 of the framework 12 having a vertical slot 42 below the first rod mounting facility 16. Each end 44 of the second rod 18 can slide within each vertical slot 42 of each side panel 28. The opposite ends 44 of the second rod 18 are externally threaded at 46. A pair of internally threaded caps 48 are provided. Each cap 48 threads onto one end 44 of the second rod 18, to maintain the second rod 18 between the vertical slots 42 in the framework 12.

The biasing structure consists of a pair of stub shafts 50. Another facility 52 is for mounting each stub shaft 50 in a generally horizontal stationary position within the framework 12 that is spaced below the second rod 18. Tow sets of elastic members 54 are provided. Each set of elastic members 54 extends between one opposite side of the second rod 18 and one stub shaft 50. A first pair of wire clips 56 are on the second rod 18, to maintain upper ends 58 of each set of elastic members 54 to the second rod 18 and prevent lateral movement thereof. A second pair of wire clips 60 are provided. Each wire clip 60 is on a first free end 62 of each stub shaft 56, to maintain lower ends 62 of each set of elastic members 54 to each stub shaft 56 and prevent lateral movement thereof.

The stub shaft mounting facility 52 includes each side panel 28 of the framework 12 having a lower aperture 64 therethrough, below the second rod mounting assemblage 20. A second end 66 of each stub shaft 50 can be force fitted into each lower aperture 64 of each side panel 28 to be retained thereto.

The improved hand grip exercise device 10 further includes a pair of padded sleeves 68. Elements 70, in which one is shown in FIG. 2, are for maintaining each padded sleeve 68 centrally to the first rod 14 and the second rod 18, so that the hand 24 of the person can comfortably grip the padded sleeves 68.

Figure 1:
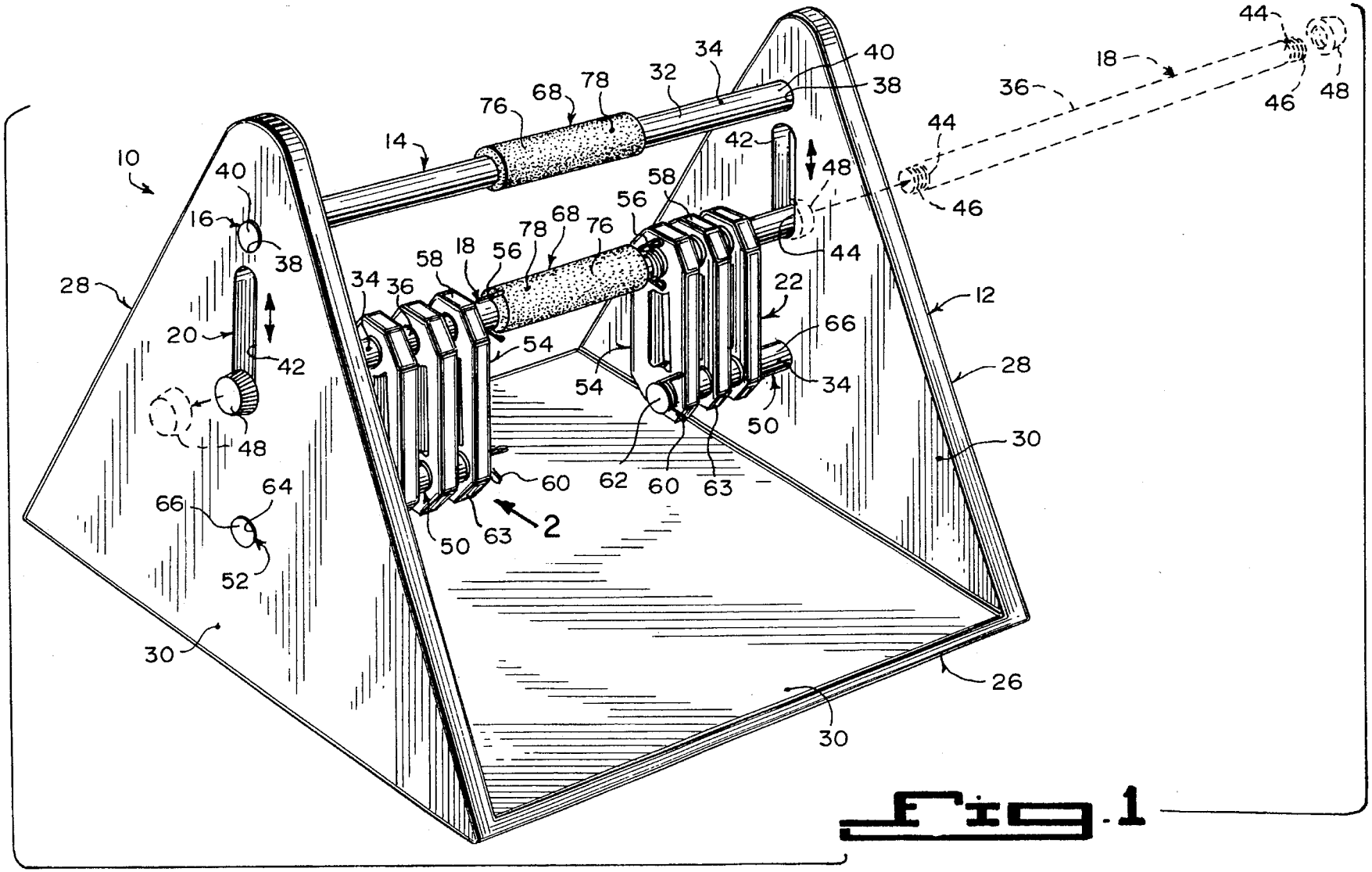
FIG. 1 is a perspective view of the instant invention and showing in dotted lines how the movable middle rod is installed therein.
Figure 2:
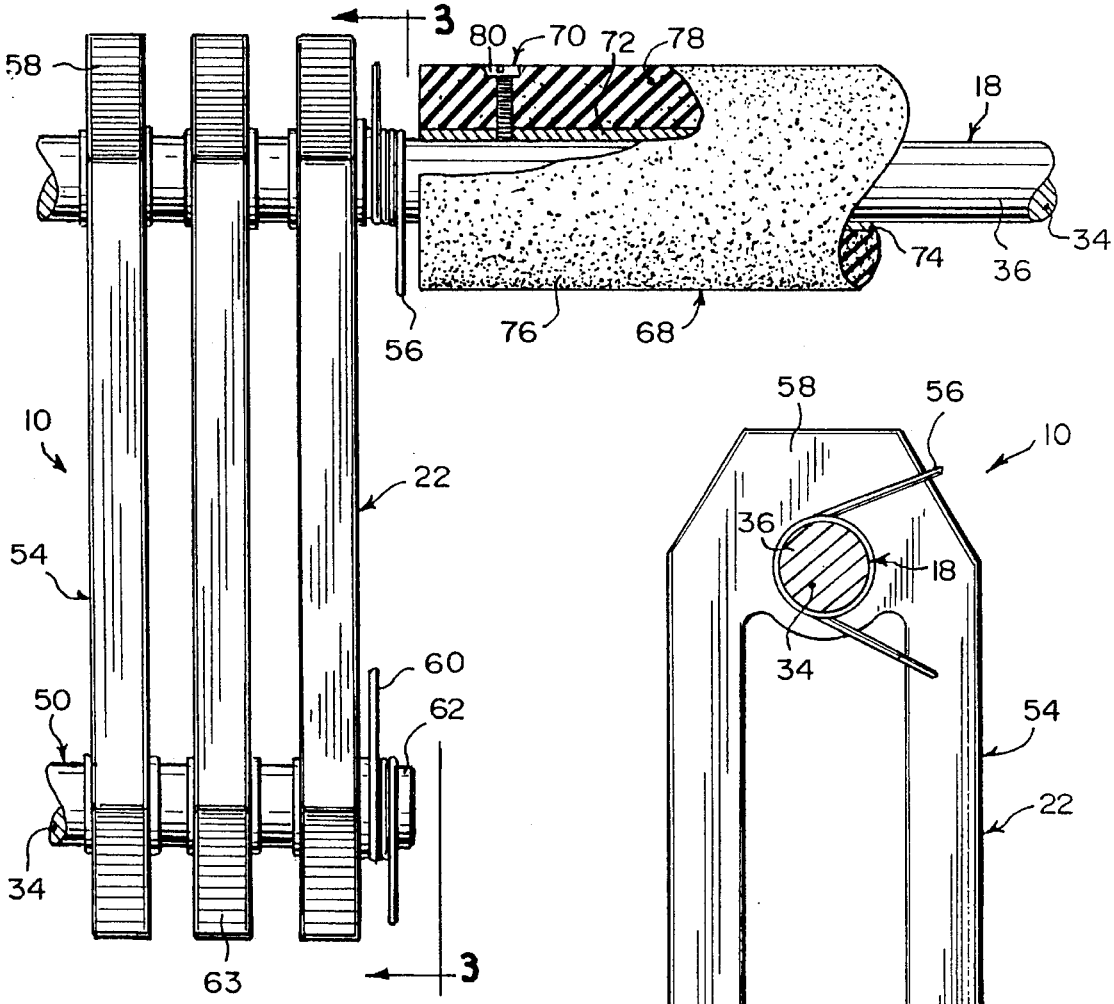
FIG. 2 is an enlarged front elevational view taken in the direction of arrow 2 in FIG. 1, with parts broken away and in section.
Figure 3:
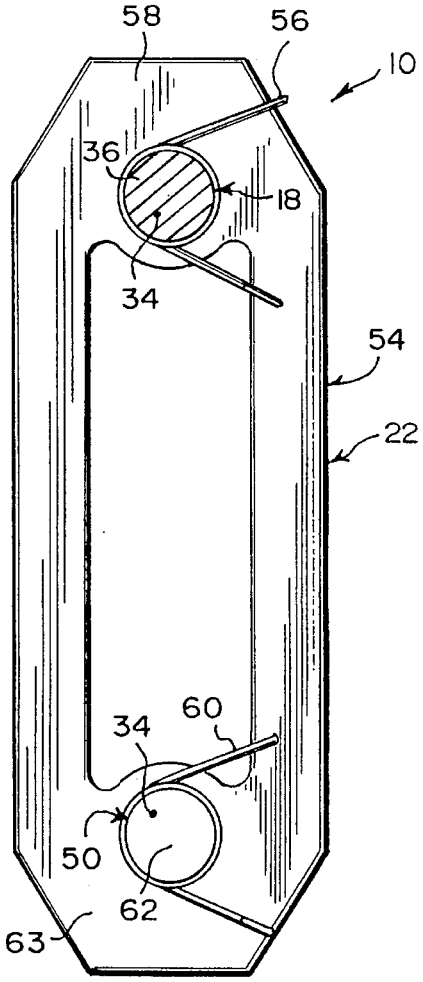
FIG. 3 is a cross sectional end view taken along line 3—3 in FIG. 2.

Each padded sleeve 68, as best seen in FIG. 2, consists of an inner tubular hollow core 72 fabricated out of a strong lightweight material 74, such as plastic or aluminum. An outer tubular hollow covering 76 fabricated out of a soft squeezable material 78, such as foam rubber, is fitted over the inner tubular hollow core 72. The maintaining elements 70 are a pair of setscrews 80. Each setscrew 80 is threaded transversely through each padded sleeve 68, so as to engage with the first rod 14 and the second rod 18.

LIST OF REFERENCE NUMBERS

10 improved hand grip exercise device
12 framework
14 first rod in 12
16 first rod mounting facility for 14
18 second rod in 12
20 second rod mounting assemblage for 18
22 biasing structure in 12
24 hand of a person
26 base plate of 12
28 side panel of 12
30 strong lightweight material for 26, 28
32 first elongated solid cylindrical bar for 14
34 strong lightweight material for 32, 36
36 second elongated solid cylindrical bar for 18
38 upper aperture in 28 for 16
40 end of 14
42 vertical slot in 28 for 20
44 end of 18
46 external threads on 44
48 internally threaded cap
50 stub shaft
52 stub shaft mounting facility for 50
54 elastic member
56 first wire clip on 18
58 upper end of 54
60 second wire clip on 50
62 first free end of 50
64 lower aperture in 28 for 50
66 second end of 50
68 padded sleeve on 14, 18
70 maintaining element for 68
72 inner tubular hollow core of 68
74 strong lightweight material for 72
76 outer tubular hollow covering of 68
78 soft squeezable material for 76
80 setscrew for 70

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An improved hand grip exercise device comprising:

a) a framework, said framework including a bas plate and a pair of side panels, in which each said side panel extends upwardly from one opposite side edge of said base plate, said base plate being rectangular shaped and fabricated out of a strong lightweight material, said each said side panel being triangular shaped and fabricated out of a strong lightweight material, said base plate and said side panels being integral, so as to form one complete unit;

b) a first rod, said first rod being a first elongated solid cylindrical bar, said first elongated solid cylindrical bar being fabricated out of a strong lightweight material;

c) means for mounting said first rod in a generally horizontal stationary position within said framework, said first rod mounting means including each said side panel of said framework having an upper aperture therethrough, so that each end of said first rod can be force fitted into each said upper aperture of each said side panel to be retained thereto;

d) a second rod, said second rod being a second elongated solid cylindrical bar, said second elongated solid cylindrical bar being fabricated out of a strong lightweight material;

e) means for mounting said second rod in a generally horizontal movable position within said framework, that is spaced below said first rod, said second rod mounting means including each said side panel of said framework having a vertical slot below said first rod mounting means, so that each end of said second rod can slide within each said vertical slot of each said side panel, said second rod mounting means further including said opposite ends of said second rod being externaly threaded, and a pair of internally threaded caps, in which each said cap threads onto one said end of said second rod, to maintain said second rod between said vertical slots in said framework;

f) mean for biasing said second rod away from said first rod within said framework, so that a person can grip said first rod and said second rod by the hand and squeeze said second rod towards said first rod, to increase the strength of the grip and the fitness of the hand; and g) a pair of padded sleeves, each said padded sleeve including an inner tubular hollow core fabricated out of a strong lightweight material, and an outer tubular hollow covering fabricated out of a soft squeezable material and fitted over said inner tubular hollow core; and h) means for maintaining each said padded sleeve centrally to said first rod and said second rid, so that the hand of the person can comfortably grip said padded sleeves, said maintaining means being a pair of setscrews, in which each said setscrew is threaded transversely through each said padded sleeve, so as to engage with said first rod and said second rod.

2. An improved hand grip exercise device as recited in claim 1, wherein said biasing means includes:

a) a pair of stub shafts;

b) means for mounting each said stub shaft in a generally horizontal stationary position within said framework that is spaced below said second rod;

c) two sets of elastic members, in which each said set of elastic members extends between one opposite side of said second rod and one said stub shaft;

d) a first pair of wire clips on said second rod to maintain upper ends of each said set of elastic members to said second rod and prevent lateral movement thereof; and e) a second pair of wire clips in which each said wire clip is on a first free end of each said stub shaft to maintain lower ends of each said set of elastic members to each said stub shaft and prevent lateral movement thereof.

3. An improved hand grip exercise device as recited in claim 2, wherein said stub shaft mounting means includes each said side panel of the framework having a lower aperture therethrough below said second rod mounting means, so that a second end of each said stub shaft can be force fitted into each said lower aperture of each said side panel to be retained thereto.

* * * * *